United States Patent [19]

Burgess

[11] 4,317,069

[45] Feb. 23, 1982

[54] MEANS AND METHOD FOR CONTROLLING LUMEN OUTPUT AND POWER CONSUMPTION OF PHOSPHOR EXCITABLE LAMPS

[76] Inventor: David E. Burgess, P.O. Box 6608, Torrance, Calif. 90504

[21] Appl. No.: 116,573

[22] Filed: Jan. 29, 1980

[51] Int. Cl.[3] ..... H05B 41/16

[52] U.S. Cl. ..... 315/227 R; 315/58; 315/187; 315/291; 315/DIG. 4; 339/50 R

[58] Field of Search ..... 315/227 R, 58, 71, 291, 315/DIG. 4, 187; 339/278 A, 50 R, 153

[56] References Cited

U.S. PATENT DOCUMENTS

| | | | |
|---|---|---|---|
| 3,956,665 | 5/1976 | Westphal | 315/187 |
| 3,989,335 | 11/1976 | Belokin | 339/50 R |
| 4,135,115 | 1/1979 | Abernethy et al. | 315/97 |
| 4,163,176 | 7/1979 | Cohen et al. | 315/58 |

*Primary Examiner*—Eugene R. La Roche
*Attorney, Agent, or Firm*—Robert J. Schaap

[57] ABSTRACT

A device and a method for reducing power consumption and correspondingly reducing lumen output of a phosphor excitable lamp, such as a fluorescent lamp, connected to a source of power for operation of the same, without any appreciable loss of operating efficiency. A capacitive element is electrically connectable to one terminal of the phosphor excitable lamp and is effectively electrically interposed between the lamp and the source of power in a series connection. The capacitive element is selected with a capacitive value so that the lumen output is reduced but with substantially uniform lumen output at the reduced level and the power consumption is reduced without substantially changing the voltage to the lamp and without any appreciable effects on the efficiency of operation of the lamp or the source of power. More specifically, the capacitive element is interposed between the conductive terminal of a socket in a fixture and the end terminal of a lamp such that a circuit path is not created directly between the conductive terminal of the socket and the end terminal of the lamp, but rather through the capacitive element to thereby reduce the power consumption and lumen output.

59 Claims, 10 Drawing Figures

MEANS AND METHOD FOR CONTROLLING LUMEN OUTPUT AND POWER CONSUMPTION OF PHOSPHOR EXCITABLE LAMPS

BACKGROUND OF THE INVENTION

1. Field of the Invention

This invention relates in general to certain new and useful improvements in a means and method for reducing power consumption of one or more lamps in a circuit arrangement and correspondingly reducing lumen output to a uniform lumen output level, while maintaining efficiency of operation of the lamp and the power source connected to the lamp for operation of the lamp, and more particularly, to a means and method of the type stated which utilizes a capacitive means for insertion in a series connection with respect to the lamp and the source of power.

2. Brief Description of the Prior Art

In many cases, conventional fluorescent light fixtures are constructed so as to physically retain and energize a pair of phosphor excitable lamps, such as the fluorescent lamps. The ballast and circuitry in these fixtures are typically designed so that the two lamps in the fixture are essentially electrically 180° out of phase. This arrangement is used in order to cancel out visible flicker to some extent. Thus, two lights in a fixture or otherwise lights in pairs are employed to reduce the noticeable effects of flicker, even though the extra lumen output of two lamps are not necessarily required.

In many cases, it has been found in office buildings and other commercial installations, that it is possible to eliminate one or more lamps of the fixture without appreciably reducing total light output so that inefficiency and eye fatigue do not result. In other words, many commercially available fixtures were constructed so that an excess of light was generated for a given purpose.

In recent years, and due at least in part to severe shortages in available energy, and particularly electrical energy, and also due to the high cost of electrical energy, there has been an interest in reducing the available light output in order to reduce the total cost of operation. However, in many of the commercially available fluorescent lamp fixtures, the removal of one of the lamps, particularly in a series connected circuit of the lamps resulted in a very substantial inefficiency of operation. If the remaining lamp was able to operate at all, depending upon the circuit configuration, then there was a resultant inefficiency in that the remaining lamp produced less light output for a given level of power consumption or otherwise the ballast in the electrical circuit which operates the lamp operated inefficiently thereby decreasing operating life.

In order to obviate these problems, there has been an introduction in the market place of the so-called "phantom tube". The phantom tube is essentially a bulb or tube similar to that of the fluorescent lamp or similar phosphor excitable lamp which was removed and which is capable of being connected between the terminals in a fluorescent lamp fixture. In this way, when one of the operating lamps was removed, the phantom tube was inserted and the remaining lamp could operate with a reasonable degree of efficiency. These phantom tubes, in one embodiment, employ a capacitor connected between the sockets from which a lamp was removed, such as the type described in U.S. Pat. No. 3,956,665 to Westphal. In other cases, the phantom tube relied upon a non-reactive lamp circuit, as for example, as described in U.S. Pat. No. 4,053,811 to Abernathy.

In each case, the phantom tube while effective in permitting reduction in power, was oftentimes undesirable due to the fact that it drew attention to the fact that one of the operating lamps was removed. Thus, it always appeared as though one of the lamps in a two lamp fixture was burned out and not replaced. In addition, the removal of one or more of the lumen producing lamps oftentimes created uneven light distribution and was therefor ineffective for the desired purpose. In addition to the above, unless the capacitor or the power factor compensating element was accurately established for a particular circuit, there was a resultant power factor loss.

In addition to the foregoing, the lamp substitute devices e.g. the so-called phantom tubes, were ineffective in some cases due to the fact that it was not easy or convenient to repair the phantom tube, particularly in the event of a capacitor burn-out. Moreover, inasmuch as these tubes were constructed primarily of glass or lightweight plastic material, they had to be carefully packaged in order to reduce the incident of breakage or damage during shipment and transportation. This resulted in an increase in the cost of the shipment and hence the cost of the phantom tubes. Notwithstanding, even with careful packaging, there was also a substantial rate of breakage and damage as a result of shipment and for that matter, improper handling during storage.

There has been at least one attempt to reduce power consumption and also lumen output in a circuit configuration which employed two or more fluorescent lamps. This one proposal has been taught in U.S. Pat. No. 4,135,115 to Abernathy et al. However, in the Abernathy et al patent, the device which is utilized is rather complex and includes a step-up transform as well as a plurality of capacitors and a resistive element. This device is constructed so as to at least step-up the voltage for a short period of time in order to achieve starting of the lamp. Moreover, this particular device is only effective for use with the so-called "rapid-start" circuit and is not effective for use in other circuit configurations, as for example, the so-called "instant-start" circuit, etc.

In addition to the above, the device in the Abernathy, et al patent is also relatively ineffective in that it must be physically connected in the circuit by disconnecting one or more of the electrical lines with respect to the ballast. Thus, it was necessary to employ someone skilled in electrical circuit work, such as a licensed electrician to disconnect the power, break one or more of the lines and connect the device taught in the Abernathy et al patent into the circuit arrangement. This resulted in down time, a substantial increase in installation costs and further, a very substantial increase in cost of the device itself.

The present invention obviates these and other problems in the provision of the very simple capacitive means which is capable of being inserted in the circuit without the necessary disconnection of any of the electrical lines. Moreover, the device of the present invention is quite simple in its construction and permits a reduction of lumen output with a corresponding reduction of power consumption and which is highly efficient.

OBJECTS OF THE INVENTION

It is, therefore, a primary object of the present invention to provide a means for limiting the power consumption and the lumen output of a phosphor excitable lamp which is connected to a source of power for operation of the same without any appreciable loss in efficiency of operation of either the lamp or the power source, by utilization of a capacitive means interposed between the lamp and the source of power in a series arrangement.

It is another object of the present invention to provide a means of the type stated which utilizes a capacitor having a value selected so that the lumen output is reduced and the power consumption is reduced but without substantially changing the voltage which is applied to the lamp.

It is a further object of the present invention to provide a means of the type stated which is capable of being electrically connected and disconnected without connecting or disconnecting anything other than the lamp.

It is also an object of the present invention to provide a device which utilizes a capacitive element for limiting the power consumption and correspondingly limiting the lumen output of a phosphor excitable lamp which is normally connected between a pair of sockets in a fixture and where the capacitive element can be interposed between an end terminal of the lamp and a conductive terminal in the socket of the fixture.

It is still another object of the present invention to provide a method of limiting power consumption and lumen output of a phosphor excitable lamp connected to a source of power without any appreciable loss of efficiency by electrically connecting a capacitive means to one terminal of the phosphor excitable lamp and electrically interposing this capacitive means between the lamp and the source of power in order to reduce the power consumption and the lumen output and yet maintain a high degree of efficiency of operation of the lamp and the source of power.

It is yet a further object of the present invention to provide a method of reducing power consumption and correspondingly reducing lumen output of a lamp by inserting a device which has a capacitive value selected to perform these functions without substantially changing the voltage which is normally applied to the lamp and which does not require physical connection and disconnection of any electrical components, other than the lamp.

With the above and other objects in view, my invention resides in the novel features of form, construction, arrangement and combination of parts presently described and pointed out in the claims.

BRIEF SUMMARY OF THE DISCLOSURE

A means for limiting power consumption and lumen output of a phosphor excitable lamp connected to a source of power for operation of the same and which means permits such reduction without appreciable loss in efficiency of operation of either the lamp or the source of power.

The term "phosphor excitable" lamp is deemed to include those lamps which utilize an excitable phosphor in order to start or maintain operation of the same and include for example, the fluorescent lamp, the so-called "cathode discharge" lamp and the electroluminescent lamp, etc. Inasmuch as these lamps are well known in the art, they are not described in any substantial detail herein.

The means for reducing the power consumption generally is a capacitive means which is electrically connectable to one terminal of the phosphor excitable lamp and is effectively electrically interposed between the lamp and the source of power in a series connection. This capacitive means is selected with a capacitive value so that the lumen output is substantially reduced but yet is substantially uniform at the reduced level. Moreover, the power consumption is substantially reduced without changing the voltage to the lamp and without appreciable effects on the efficiency of operation of the lamp or the source of power.

The means of the invention is highly effective in that it permits interposition of the capacitive means without electrically connecting or disconnecting any wire or other component, other than the lamp itself. Moreover, the invention is effective in that the means consists essentially of the conductors associated with a capacitor and the capacitor itself. Thus, it is not necessary to employ any complex circuitry including inductive members, such as transformers, resistors or the like.

In one preferred embodiment of the invention, the capacitive means has a capacitive value of from about eight microfarads to about fourteen microfarads. In a more preferred embodiment of the invention, the capacitive means has a capacitive value of from about nine microfarads to about twelve microfarads.

The capacitive means of the invention is primarily effective in limiting the power consumption and lumen output of a plurality of phosphor excitable lamps and preferably a plurality of such lamps in a series circuit arrangement, that is where the lamps are in a series arrangement with respect to each other and with respect to a source of power for operation of the lamps. In this case, as for example, where two such lamps are connected in a series arrangement, it is only necessary to use the capacitive means with one of the lamps. This will cause a reduction of lumen output and a corresponding reduction of power consumption with respect to both lamps in the fixture.

Typically, the fixtures which retain phosphor excitable lamps, such as fluorescent lamps, are provided with a pair of spaced apart sockets which receive the ends of the lamp. Particularly, the sockets are provided with conductive terminals electrically connected to the circuit which provides power, as for example, the ballast. Moreover, the lamps are also provided with one or more terminals on each of the ends. The number of terminals in many cases is dependent upon the type of operation and the circuit arrangement used in the ballast. The invention is effective in that at least one end of the lamp is connectable to the capacitive means which is, in turn, connectable to the conductive terminal in the socket. In this way, it is not necessary to break any electrical lines or the like. Moreover, it is important to note that a different electrical circuit path is established through the capacitor as opposed to a circuit path from the end terminal of the lamp directly to the conductive terminal in the socket. It is this different electrical circuit path which permits the high degree of efficiency in operation with the substantially reduced lumen output and power consumption.

In a more preferred aspect of the invention, the capacitive means exist in the form of a device such as a relatively thin wafer which is capable of being interposed between the end terminal on the lamp and the conductive terminal in the socket. This device is generally comprised of a first conductive element which is adapted to be engaged by and establish electrical connection with at least one end terminal of the lamp. The device also includes a second conductive element which is adapted to engage and establish an electrical connection with a conductive terminal of the socket. An electrically non-conductive element is located between the two conductive elements. Moreover, the capacitor is electrically connected to the two conductive elements such that the circuit path is not established directly through the end terminals of the lamp and the conductive terminal of the socket, but rather through the capacitor itself.

In another embodiment with respect to the device, the aforesaid conductive elements and the non-conductive element are suitably, located within a housing and preferably an electrically non-conductive housing. In this case, a recess is formed in the housing to receive the end terminal, such as the pin, on the lamp. Moreover, a prong is formed on the other side of the housing and is connected to the first of the electrically conductive elements for insertion into the socket. This prong will essentially have the same size as the end terminal or pin on the lamp.

It is possible to insert the device of the invention between one end of the lamp and the socket inasmuch as the fixture is generally constructed so that one of the sockets is provided with a spring means to provide some leeway and space for the lamp to be shifted back and forth for purpose of removal and reinsertion.

The device of the present invention is referred to primarily as a capacitive element. Moreover, the means for creating the reduction of power consumption and lumen output consists essentially of the capacitive means. In this case, the capacitive means is deemed to include that wafer and the electrical elements therein as well as the non-conductive element therein inasmuch as the electrically conductive elements and the non-conductive element only serve to establish a path to the capacitor. In other words, there is no electrically effective element other than the capacitor itself.

This invention possesses many other advantages and has other purposes which may be made more clearly apparent from a consideration of the forms in which it may be embodied. These forms are shown in the drawings forming and accompanying part of the present specification. They will now be described in detail for the purposes of illustrating the general principals of the invention, but it is to be understood that such detailed descriptions are not to be taken in a limiting sense.

BRIEF DESCRIPTION OF THE DRAWINGS

Figure 1:
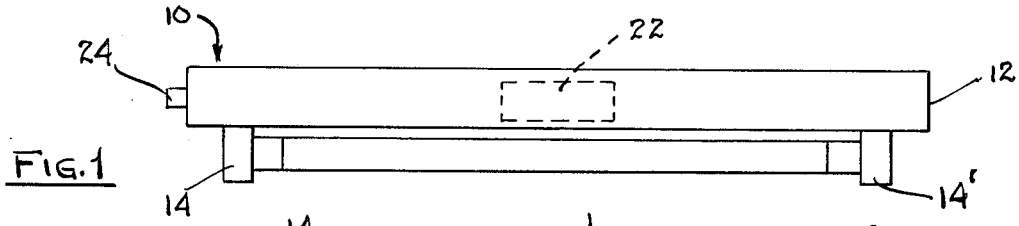
Figure 2:
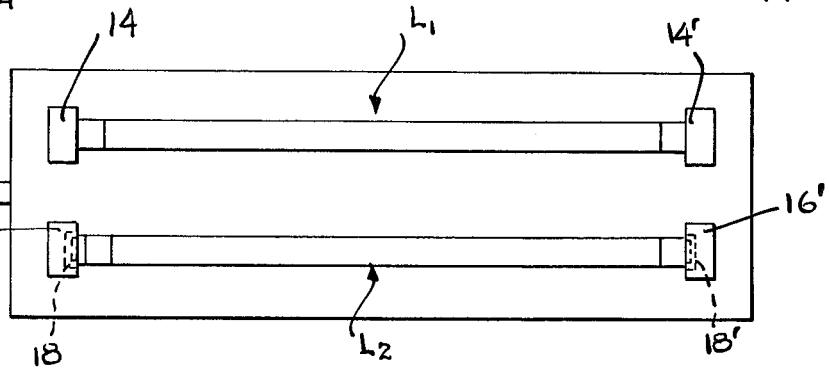
Figure 3:
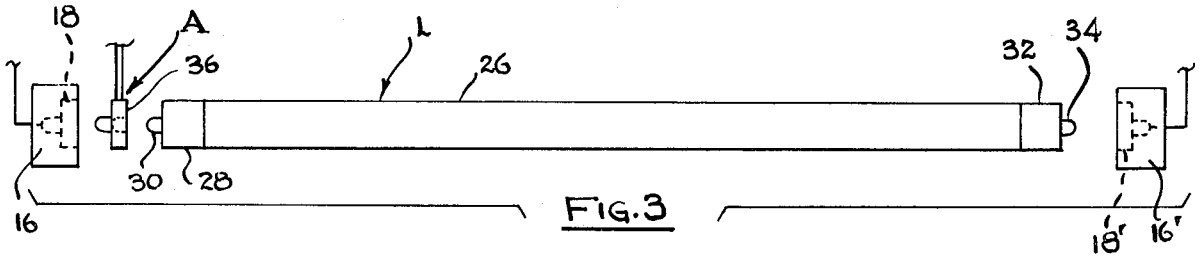
Figure 4:
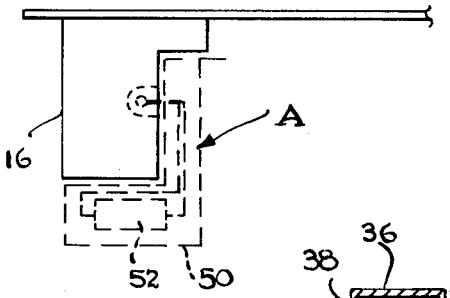
Figure 5:
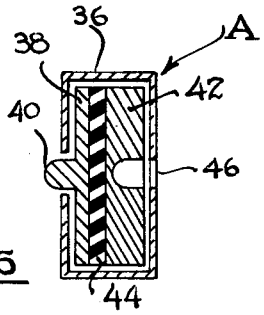
Figure 7:
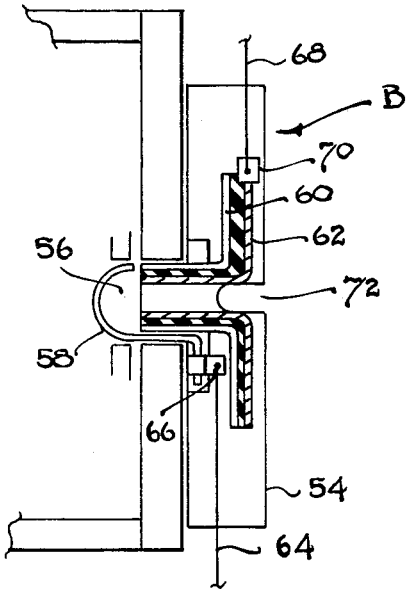
Figure 6:
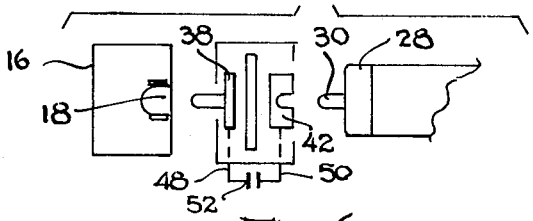
Figure 8:
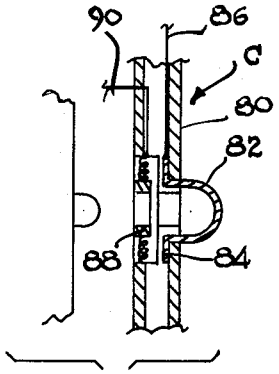
Figure 9:
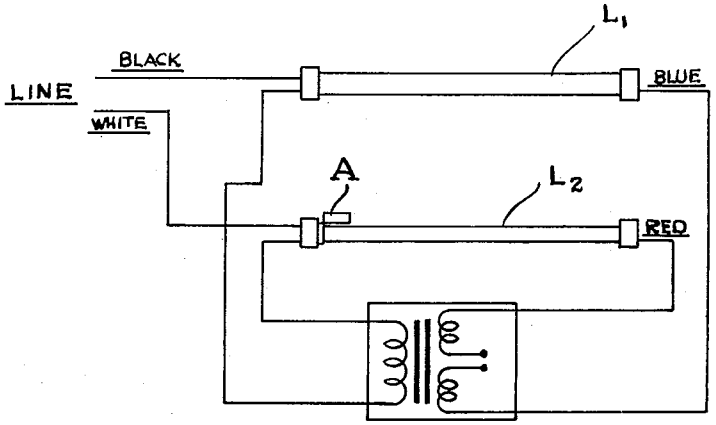
Figure 10:
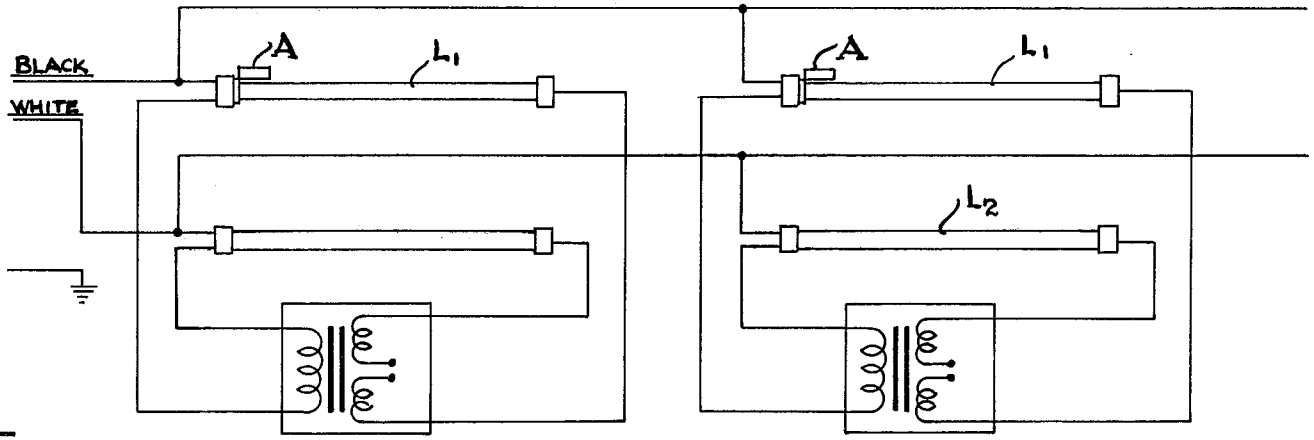

Having thus described the invention in general terms, reference will now be made to the accompanying drawings in which:

FIG. 1 is a side elevational view of a conventional light fixture with phosphor excitable lamps mounted in the sockets thereof;

FIG. 2 is a bottom plan view of the fixture of FIG. 1 and showing a pair of phosphor excitable lamps mounted in the sockets thereof and with a capacitive device of the present invention inserted between one of the ends of one of the lamps and one socket thereof;

FIG. 3 is an exploded side elevational view, partially in dotted lines, showing the capacitive means in relation to one end of a conventional fluorescent lamp and with respect to a pair of spaced apart sockets;

FIG. 4 is a side elevational view, partially in phantom lines, and showing one form of capacitive device used in the present invention;

FIG. 5 is a somewhat schematic vertical sectional view showing the components forming part of the capacitive device of the present invention;

FIG. 6 is an exploded side elevational view, somewhat schematic in nature, and showing the interposition of the capacitive device of FIG. 5 with respect to an end of a lamp and a socket of the fixture;

FIG. 7 is a vertical sectional view and showing a more detailed construction of one embodiment of a capacitive device constructed and in accordance with and embodying the present invention;

FIG. 8 is a vertical sectional view showing a modified form of a capacitive device of the present invention;

FIG. 9 is a schematic electrical circuit view showing the use of a capacitive device of the present invention with one of the light emitting lamps in a so-called "instant start" circuit arrangement; and FIG. 10 is a schematic electrical circuit arrangement, similar to FIG. 9, and showing the capacitive devices of the present invention used with one lamp in each of a pair of series connected fixtures.

DETAILED DESCRIPTION OF PREFERRED EMBODIMENTS

Referring now in more detail and by reference characters to the drawings which illustrated practical embodiments of the present invention, FIGS. 1 and 2 show a conventional fixture 10 of the type which holds and provides energization and resultant lumen output from phosphor excitable lamps, e.g. fluorescent lamps.

The fixture is generally provided with an outer housing 12 having a generally rectangular shape as illustrated. Moreover, depending from a bottom wall of the housing 12 are two pairs of connector plates 14 and 14' and 16 and 16', as more fully illustrated in FIG. 2 of the drawings. Each of the connector plates are provided with sockets of the type normally found in conventional fluorescent light fixtures. Thus for example, the connector plates 16 and 16' are provided with sockets 18 and 18' respectively. Moreover, these sockets are typically bayonet type sockets and include the conductors therein for creating an electrical circuit through the phosphor excitable lamp such as a lamp L.

FIG. 6 schematically illustrates a pair of conductors in the socket 18 of the connector plate 16. Moreover, and in this case, the electrical conductors 20 which are often referred to as "conductive terminals", are connected in spaced apart relationship. In this way, a single pin tube may be used to establish contact between the two conductive terminals 20.

Also normally included within the housing, although it may be located elsewhere, is a conventional ballast 22. The ballast is electrically connected to the sockets and particularly the conductive terminals 20 in the sockets 18 and 18'.

Various circuit arrangements may be employed in these conventional fluorescent fixtures. For example, the circuit arrangement may be that of the so-called "instant start" circuit arrangement or the so-called "rapid start" circuit arrangement. In any event, the fixture is generally designed so that two or more phosphor excitable lamps, such as the lamps designated as $L_1$ and $L_2$ in FIG. 2, are connected in a series relationship with respect to each other or with respect to the ballast 22 or other power source. In like manner, the fixture may be provided with a fuse cap 24 for retaining a fuse in the electrical circuit including the ballast 22.

The typical fluorescent lamp is only one embodiment of a phosphor excitable lamp as aforesaid, and is also a gaseous discharge lamp. The typical fluorescent lamp comprises a tube 26, which is shown as having a straight glass tube, although the tube often adopts other shapes, as for example, a circular shape, or the like. One end of the tube is provided with a base or end cap 28 having one or more electrical terminals 30 at each end, often called "end terminals". A similar end cap 32 having one or more terminals 34 (one as shown) is located at the opposite end of the tube 26.

These terminals, which are also often referred to as "base pins", are connected to lead-in wires located internally within the tube, and the lead-in wires are located in a so-called "stem press" constructed of a material to assure the same coefficient of expansion as the glass tube. The lead-in wires are connected to a cathode which may be a hot cathode which is designed to ignite a gas in the tube as hereinafter described. The hot cathode is coated with an emissive material which emits electrons and is usually made of a coil, e.g., a simple coil of tungsten wire. In many commercial embodiments, a pair of similar hot cathodes and related structure would be included at each end of the glass tube.

The inside of the bulb or tube is provided with a phosphor coating which transforms ultraviolet radiation into the visible light. The color of the light often depends on the composition of the phosphor. A minute amount of mercury is also located in the lamp to furnish the mercury vapor for purposes of ignition. In addition, an inert gas, such as argon, krypton, and the like, may be used. The coating on the hot cathode is generally formed of an emissive material such as barium, strontium, calcium oxide, or the like, and which emits electrons when heated to an operating temperature of about 950 degrees C. After the cathode has been heated to the proper temperature, thermionic emission will occur. The emitted electrons, upon collision, will release ultraviolet radiation which is converted into visible light by the phosphors.

The conventional electroluminescent lamp is comprised of a plastic plate which is translucent and preferably transparent in its construction. Applied to one surface of this plate is a phosphor coating and disposed against the phosphor coating is a metal sheet such as an aluminum sheet. Conductors are attached to the phosphor coating and the metal sheet. These conductors are adapted for connection to a suitable source of current through a ballast, and in the case of the present invention, would be connected to inputs of the generator. The electroluminescent lamp operates on essentially the same principle as the gaseous discharge lamp. However, in this case, the phosphors are not located in a tube or bulb. The electroluminescent lamp operates with a very high frequency creating a capacitive effect across the phosphor coating and the metal sheet with the phosphors converting the ultraviolet radiation into visible light radiation.

FIG. 3 is a somewhat schematic representation of the alteration occuring in the circuit arrangement when a capacitive device of the present invention is used with one or more lamps. In this respect, it should be observed that the capacitive device is always used in a series connection with a single lamp with respect to a power source. In the event where one or more lamps are connected with respect to a power source, such as a ballast, and particularly in a series arrangement of the lamps, the capacitive device is also always used in a series circuit connection.

The term "power source" is also deemed to include that source of electrical power which may be the line power such as a 110 volt AC electrical circuit, or otherwise, the ballast itself. Thus, in some cases, the input power is introduced directly into the ballast, as in the so-called "instant start" arrangement. Nevertheless, the ballast in this case is also deemed to be the power source.

In the arrangement in FIG. 3, it can be observed that a conventional fluorescent lamp L is located between a pair of sockets, as for example, the sockets 16 and 16'. At the left-hand end of the lamp L, a capacitive device A of the present invention is inserted between the lamp and the conductive terminal in the lamp socket. In this case, it can be observed that the capacitive device A includes a disc like housing 36 which is capable of being fitted within the socket 18 of the connector plate 16. Moreover, the end pin or end terminal of the lamp is adapted to be inserted into the housing 36, in the manner as hereinafter described.

The capacitive device A of the invention is more fully illustrated in FIG. 5 and 6 of the drawings. In this case, the capacitive device A includes the outer housing 36. Moreover, included within the outer housing 36 is a first electrically conductive element 38 which is provided with a projection 40 extending beyond the housing. In this case, the projection 40 has essentially the same size and overall shape as the terminal pin 30 of the lamp. In addition, the housing 36 is sized to extend into the socket or at least a portion of the socket 18 as aforesaid. Thus, when the housing is so inserted, the projection 40 will contact the conductors 20 within the socket, much in the same manner as the end pin 30 on the lamp L. It should also be understood, in connection with the present invention, that when bi-pin or double-pin lamps are used, the capacitive device A would also be provided with a similar pin arrangement. The capacitive device A also includes a second electrically conductive element 42 and which is spaced from and insulated from the conductive element 38 by an electrically non-conductive element 44. The housing is also provided on its right-hand end, reference being made to FIGS. 5 and 6, with a recess 46 which opens into the conductive element 42. Thus, when the capacitive device A of the invention is used, the end terminal or pin 30 on the lamp L will extend through the recess 46 and contact the conductive plate 42.

By reference to FIG. 6, it can be observed that the housing 36 is preferably in the form of a relatively thin disc like member. Consequently, in many cases, it is not easy to include the capacitor directly in the housing. In this case, where the capacitor cannot be included in the housing, a pair of leads 48 and 50 are connected to the respective electrically conductive elements 38 and 42 and which are in turn, connected to a capacitor 52. The capacitor itself may also be enclosed within a suitable housing, in the manner as illustrated in FIG. 4, such that a complete individual housing is connected to one socket as for example, a recess to receive the terminal pin or pins at the end of the lamp. In this respect, it should be understood that these conductive elements 38 and 42 are merely separated by the non-conductive element 44 to prevent short-circuiting, and these elements, as such, do not function as a separate capacitor per se, although they could be designed to so operate.

The capacitive device is also designed and sized so that it is capable of being disposed within a socket of the connector plate. The pin on the end of the lamp would then fit within a recess on the capacitive device. However, it should be understood that the capacitive device could be designed so that it fits over the end of the pin on the tube, with the prong of the capacitive device extending into contact with the conductive elements in the socket. On such embodiment where the capacitive device fits over the end of the pin is hereinafter described in detail.

In the embodiment of the capacitive device as illustrated, it can be observed that the housing 36 is preferably formed of an electrically non-conductive material. In this way, if a capacitor is still charged when one attempts to remove the capacitive device, there will be no potential damage or injury. In this respect, the housing includes a portion which extends into the recess 46 so as to electrically isolate the same. Consequently, it would be difficult for one to stick his or her finger into this recess. Even if the user of the device attempted to contact the projection 40 he or she would not be able to contact the conductive element 42 and thus, no electrical short could occur, even though the capacitor 52 had some residual charge.

It can be observed particularly from FIG. 6, that when the capacitive device A of the invention is used, an entirely different circuit path is established. In this case, as opposed to a circuit path being created from the terminal end e.g. the terminal pin 30 on the lamp directly to the conductive terminal 20 in the socket, the path is created through the terminal pin 30, the conductive element 42, the capacitor 52, the conductive element 38, projection 40 and then the conductive terminal 20.

The capacitor has a capacitive value established so as to minimize any power factor loss and to maintain a high degree of efficiency of operation. It has been found in connection with the illustrated device, that the capacitive value may range from about eight microfarads to about fourteen microfarads. In a more preferred embodiment, the capacitive value of the capacitor used should range from about nine microfarads to about twelve microfarads. It has been found in this case, that on the average, electrical power reduction is about 30% in a two lamp circuit arrangement and the illumination is reduced about 30%. Consequently, there does not appear to be any significant loss in percentage of illumination with respect to the percentage in power reduction. Equally important is the fact the the ballast and the lamps and the life of these components are not damaged. Contrariwise, the life of the lamp and the ballast itself has increased substantially by virtue of the reduction of power used in operating both.

FIG. 7 illustrates one preferred embodiment of a capacitive device B which may be used. In this case, the capacitive device B generally comprises an outer housing 54 which is preferably formed of a non-conductive material and which is provided with a central opening 56 along one of the flat walls thereof, as the left-hand flat wall in the manner as illustrated in FIG. 7. Located within the housing 54 is an electrically conductive strip 58 which is curved and shaped so as to form a shape similar to that of the projection 40. Moreover, the shape of the strip 58 which forms this projection is similar to that of a pin, such as the terminal pin 30 on the lamp. By reference to FIG. 7, it can be observed that the strip 58 does not extend all the way into the housing but is spaced apart from a similar strip 60 which is secured within the housing 54 and extends outwardly therefrom to aid in the formation of a shape equivalent to that of the projection. Also located within the housing 54 is a second conductive strip 62. The conductive strip 58 is connected to a first electrically conductive wire 64 by means of a clamp 66. A second electrically conductive wire 68 is connected to the strip 62 by means of a clamp 70 also in the manner as illustrated in FIG. 7. These two electrically conductive wires 64 and 68 would be suitably connected to a capacitor, such as the capacitor 52.

The right-hand end of the housing 54 is provided with a recess 72 having a size and shape similar to the terminal pin 30 on any one of the fluorescent lamps. In this case, the recess is at least partially open so that a terminal pin on the lamp will contact the conductive strip 62 located adjacent to the recess.

Also located within the housing 54 is an insulator which surrounds the conductive strip 62 and electrically insulates the same from the conductive strip 60 or the conductive strip 58 which forms the projection. In this way, the equivalent structure of that illustrated in FIGS. 5 and 6 is achieved. This embodiment of the capacitor device has been found to be highly effective and is easy to manufacture and moreover, is relatively easy to repair.

FIG. 8 illustrates a capacitive device C which is designed to fit over the end of a pin on a fluorescent tube or similar phosphor excitable lamp and have a projection thereof extend into the socket of the lamp. In other words, this device is capable of fitting over the end of the tube, e.g., on the pin as opposed to being inserted into the socket itself. The device C generally comprises an outer housing 80 which is preferably formed of an electrically non-conductive material such as a plastic or the like. Extending outwardly from one side of the housing 80 is a metallic prong 82 which is of a size similar to that of a pin on the end of a fluorescent lamp. Thus, this projection 82 is sized to extend within the socket which normally receives a conventional fluorescent lamp.

The projection 82 is provided with outwardly flaring flange 84 serving as a terminal within the housing 80. An electrically conductive wire 86 connected to this flange 84. In addition, a cylindrically shaped ring 88 is also located on the opposite side of the housing with respect to the projection 82 and is effectively electrically insulated by the housing from the flange 84. The ring 88 is also electrically connected to a conductive wire 90. Moreover, the conductors 86 and 90 are connected to a capacitor of the type previously described.

FIG. 9 illustrates a circuit arrangement and particularly the so-called "instant start" circuit arrangement in which a pair of fluorescent $L_1$ and $L_2$ are connected in series. In this case, a capacitive device has been used with the lamp $L_2$. It can be observed that the capacitive device of the invention has been inserted at the left-hand end socket although it could be located on the right-hand end socket.

Typically, many of the fluorescent lamp fixtures usually include within the fixture a black colored lead and a white colored lead, the black colored lead designating the so-called "hot" terminal and the white colored lead designating the so-called "ground" terminal as in a conventional 120 volt electrical power line. Moreover, conventional fixtures often include a blue colored electrically conductive line and a red colored electrically conductive line. These latter two electrical lines or wires are generally connected to one of the coils in the transformer of the ballast. In the preferred embodiment of the invention, the capacitive device is preferably used at that socket which includes either the blue conductor or the red conductor and preferably that socket which has the blue conductor connected thereto.

FIG. 10 illustrates a circuit arrangement very similar to FIG. 9 although two such fixtures using the instant start circuit arrangement are connected in series. Here again, the capacitive device is shown as being located in conjunction with the lamp $L_1$ in one of the fixtures and a similar lamp $L_1$ in the next adjacent fixture. No capacitive devices are used in connection with the lamps $L_2$ in either of these fixtures. In accordance with the above, it can be observed that the circuit path is changed in both the rapid start and the instant start circuit arrangements. Moreover, the circuit path is changed by the mere insertion of the capacitive device in the tandem circuit arrangements as illustrated in FIG. 10.

In one embodiment of the invention, a 4 microfarad capacitive device was connected in series with one of the fluorescent lamps in a two lamp fixture. The lamps gave off 65 foot candles with an 0.80 amp and 120 volt power source and which created 88 watts of active power. However, there was a 97.2 watts of apparent power. The power factor was approximately 90.5% with an apparent 53% savings in energy.

In another embodiment, a 5 microfarad capacitor was used with an input power of 0.80 amps and a 120 volts presenting 96 watts of active power. In this case, it was determined that there was a 100% power factor with no loss of power whatsoever but with a significant reduction in the amount of power used to illuminate the lamps.

With a 2 microfarad capacitor, it was found generally that the power was reduced about 50% although the lumen output was reduced approximately 60%. Therefore, while the invention is operable with capacitors having a capacitive value of less than 3 microfarads and greater than 6 microfarads it is preferable to employ capacitors within the range of 4 to 5 microfarads.

Thus, there has been illustrated and described a unique and novel means and method for reducing lumen output and power consumption of a phosphor excitable lamp in a single lamp or plural lamp arrangement without any appreciable effect on efficiency of the lamp or power source therefor. Thus, the present invention fulfills all of the objects and advantages sought therefore. It should be understood that many changes, modifications, variations, and other uses and applications will become apparent to those skilled in the art after considering this specification and the accompanying drawings. Therefore, any and all such changes, modifications, and other uses which do not depart from the spirit and scope of the invention are deemed to be covered by the invention which is limited only by the following claims.

Having thus described my invention, what I desire to claim and secure by letters patent is:

1. A means for use with and for limiting power consumption and lumen output of a conventional phosphor excitable lamp connected to a source of power for operation of same without any appreciable loss in efficiency of operation, said means comprising:

a capacitive means operatively physically interposed between a conductive end terminal of said conventional phosphor excitable lamp and a socket which received the end terminal of said lamp, said capacitive means also being electrically connectable to said one conductive end terminal of said phosphor excitable lamp and a conductive terminal in said socket and thereby effectively electrically interrupting the connection between the conductive end terminal of the lamp and end terminal of the socket so as to be electrically interposed between said same conventional lamp and source of power in a series connection and so that said lamp remains in circuit relation to said source of power, said capacitive means being selected with a capacitive value so that the lumen output at the reduced level and the power consumption is reduced without substantially changing the voltage to the lamp and without any appreciable effect on the efficiency of the operation of said lamp or source of power.

2. The capacitive operable means for limiting power consumption and lumen output of claim 1 further characterized in that said means is capable of being electrically connected without connecting or disconnecting anything other than said lamp.

3. The capacitive operative means for limiting power consumption and lumen output of claim 2 further characterized in that said means consists essentially of conductive means and said capacitive means.

4. The capacitive operable means for limiting power consumption and lumen output of claim 3 further characterized in that said capacitive means has a capacitive value from about eight microfarads to about fourteen microfarads.

5. The capacitive operable means for limiting power consumption and lumen output of claim 3 further characterized in that said capacitive means has a capacitive value from about nine microfarads to about twleve microfarads.

6. The capacitive operable means for limiting power consumption and lumen output of claim 2 further characterized in that said capacitive means comprises a first conductive element operatively engageable with the terminal on said lamp and a second conductive element electrically connectable to said source of power, an electrically non-conductive element separating said first and second conductive elements, and a capacitor means connected across said first and second conductive elements.

7. The capacitive operable means for limiting power consumption and lumen output of claim 1 further characterized in that said means is used to limit power consumption and lumen output of a plurality of phosphor excitable lamps in a series circut arrangement of such lamps with respect to each other and with respect to a source of power for operation of said lamps, said means being adapted to be interposed between one of the lamps and the source of power.

8. The capacitive operable means for limiting power consumption and lumen output of claim 1 further characterized in that said lamp is a fluorescent lamp.

9. An insertable means for use with and for limiting power and corresponding limiting lumen output of a conventional phosphor excitable lamp removably retained in a fixture having a pair of spaced apart sockets with each socket having a conductive terminal and which sockets retain and connect conductive end terminals of a conventional phosphor excitable lamp, said insertable means comprising:

a capacitive means operatively interposed between the conductive terminal in at least one of the sockets and the end terminal of the lamp at that socket and also retaining the lamp in the spaced apart sockets such that a circuit path originally between the conductive end terminal of the lamp and conductive terminal of that socket is no longer created directly between the conductive terminal of that socket and the end terminal of the lamp but rather through the capacitive means, to thereby limit power consumption and lumen output without appreciably affecting efficiency of operation of said lamp, and where said insertable means can be removed with the lamp remaining in or being reconnected between the pair of spaced apart sockets so that the lamp lumen output will increase to its original amount.

10. The means for limiting power consumption and correspondingly limiting lumen output of claim 9 further characterized in that said capacitive means is effectively electrically interposed between a source of electrical power for said lamp and said lamp and said capacitive means being selected with a capacitive value so that the lumen output is reduced but with substantially uniform lumen output at the reduced level and the power consumption is reduced without substantially changing the voltage to the lamp and without any appreciable effect on the efficiency of operation of said lamp or source of power.

11. The means for limiting power consumption and lumen output of claim 9 further characterized in that said means consists essentially of said capacitive operable means.

12. The means for limiting power consumption and lumen output of claim 9 further characterized in that said capacitive means has a capacitive value from about eight microfarads to about fourteen microfarads.

13. The means for limiting power consumption and lumen output of claim 9 further characterized in that said capacitive means has a capacitive value from about nine microfarads to about twelve microfarads.

14. The means for limiting power consumption and lumen output of claim 9 further characterized in that said capacitive means comprises a first conductive element operatively engagable with the terminal on said lamp and a second conductive element electrically connectable to said conductive terminal of said socket, an electrically non-conductive element separating said first and second conductive elements, and a capacitor connected across said first and second conductive elements.

15. The means for limiting power consumption and lumen output of claim 9 further characterized in that said capacitive means comprises:

(a) a first conductive element adapted to be engaged by and establish an electrical connection with an end terminal of said lamp, (b) a second conductive element adapted to engage and establish an electrical connection with a conductive terminal of said socket (c) an electrically non-conductive element between said first and second conductive elements electrically insulating same, and (d) a capacitor electrically connected to said first and second conductive elements such that an electrical circuit path is not established directly through the end terminal of said lamp and the conductive terminal of said socket when said device is used but rather through the end terminal of said lamp, said capacitor and the conductive terminal of said socket.

16. The means for limiting power consumption and lumen output of claim 15 further characterized in that said conductive elements and said non-conductive element are closed within a housing.

17. The means for limiting power consumption and lumen output of claim 16 further characterized in that a recess is formed in said housing and communicating with said first conductive element, and a prong is located on said housing and is in electrical contact with said second conductive element and adapted to extend into said socket.

18. The means for limiting power consumption and lumen output of claim 9 further characterized in that said means is used to limit power consumption and lumen output of a plurality of phosphor excitable lamps in a series circuit arrangement of such lamps with respect to each other and with respect to a source of power for operation of said lamps, said means being adapted to be interposed between the conductive terminal of at least one of the sockets and the end terminal of the lamp at that socket.

19. The means for limiting power consumption and lumen output of claim 9 further characterized in that said lamp is a fluorescent lamp.

20. A device for limiting the power consumed by a conventional phosphor excitable lamp having electrically conductive end terminals which are electrically connectable to conductive terminals in a pair of spaced apart sockets adapted to retain said phosphor excitable lamp, and where said lamp has a length such that it can be fitted within and retained by the spaced apart sockets, said device being adapted to be interposed between one of the end terminals of said lamp and one of said sockets to interrupt the electrical circuit path between and establish a different electrical circuit path between said conductive terminal of said socket and said end terminal of said lamp, said device comprising:

(a) a first conductive element adapted to be engaged by and establish electrical connection with an end terminal of said lamp, (b) a second conductive element adapted to engage and establish electrical connection with a conductive terminal of said socket, (c) an electrically non-conductive element between said first and second conductive elements electrically insulating same, and (d) a capacitor electrically connected to said first and second conductive elements such that an electrical circuit path is not established directly through the end terminal of said lamp and the conductive terminal of said socket when said device is used but rather through the end terminal of said lamp, said capacitor and the conductive terminal of said socket.

21. The device of claim 20 further characterized in that said capacitor is spaced apart from said conductive elements and is electrically connected thereto through conductive wires.

22. The device of claim 21 further characterized in that said conductive elements and said non-conductive element are enclosed within a housing.

23. The device of claim 22 further characterized in that a recess is formed in said housing and communicating with said first conductive element, and a prong is located on said housing and is in electrical contact with said second conductive element and adapted to extend into said socket.

24. The device of claim 20 further characterized in that said capacitor has a capacitive value from about eight microfarads to about fourteen microfarads.

25. The device of claim 20 further characterized in that said capacitor has a capacitive value from about nine microfarads to about twelve microfarads.

26. The device of claim 20 further characterized in that said device is used to limit power consumption and lumen output of a plurality of phosphor excitable lamps in a series circuit arrangement of such lamps with respect to each other and with respect to a source of power for operation of said lamps, said device being adapted to be interposed between the conductive terminal of at least one of the sockets and the end terminal of the lamp at that socket.

27. The device of claim 20 further characterized in that said lamp is a fluorescent lamp.

28. A method for limiting power consumption and lumen output of a conventional phosphor excitable lamp connected to a source of power for operation of same without any appreciable loss in efficiency of operation, said method comprising:

operatively physically interposing a capacitive means between an electrically conductive end terminal of a conventional phosphor excitable lamp and an electrically conductive end terminal in said socket which receives the end terminal of said lamp, and thereby electrically interrupting the connection between the end terminal of the lamp and end terminal of the socket and thereby connecting said capacitive means to said one end terminal of said phosphor excitable lamp and said socket, said step of interposing effectively electrically interposes the capactive means between said lamp and source of power in a series connection so that said same lamp remains in circuit relation to said souce of power, said capacitive means being selected with a capacitive value so that the lumen output is reduced but with substantially uniform lumen output at the reduced level and the power consumption is reduced without substantially changing the voltage to the lamp and without any appreciable affect on the efficiency of operation of said lamp or source of power.

29. The method for limiting such consumption and lumen output of claim 28 further characterized in that said method comprises physically interposing said capacitive means without connecting or disconnecting anything other than said lamp.

30. The method of claim 28 further characterized in that said capacitive means has a capacitive value from about eight microfarads to about fourteen microfarads.

31. The method of claim 28 further characterized in that said capacitive means has a capacitive value from about nine microfarads to about twelve microfarads.

32. The method for limiting power consumption and lumen output of claim 28 further characterized in that said method limits power consumption and lumen output of a plurality of phosphor excitable lamps in a series circuit arrangement of such lamps with respect to each other and with respect to a source of power for operation of said lamps, said method comprising interposing the capacitive means between at least one of the lamps and the source of power.

33. The method of claim 28 further characterized in that said lamp is a fluorescent lamp.

34. A method for limiting power consumption and correspondingly limiting of lumen output of a conventional phosphor excitable lamp removably retained in a fixture having a pair of spaced apart sockets with each socket having a conductive terminal and which sockets retain and connect end terminals of a conventional phosphor excitable lamp, said method comprising:

operatively interposing a capacitive means between the conductive terminal in at least one of the sockets and the end terminal of the lamp at that socket and also retaining the lamp in the spaced apart sockets such that a circuit path originally between the conductive end terminal of the lamp and conductive terminal of that socket is no longer created directly between the conductive terminal of that socket and the end terminal of the lamp but rather through the capacitive means, to thereby limit power consumption and lumen output without appreciably affecting efficiency of operation of said lamp, and where said capacitive means can be removed with the lamp remaining in or being reconnected between the pair of spaced apart sockets so that the lamp lumen output will increase to its original amount.

35. The method of claim 34 further characterized in that said method comprises selecting said capacitive means with a capacitive value so that lumen output is reduced but with substantially uniform lumen output at the reduced level and the power consumption is reduced without substantially changing the voltage to the lamp and without any appreciably effect on the efficiency of operation of said lamp.

36. The method of claim 35 further characterized in that said capacitive means has a capacitive value from about eight microfarads to about fourteen microfarads.

37. The method of claim 35 further characterized in that said capacitive means has a capacitive value from about nine microfarads to about twelve microfarads.

38. The method for limiting power consumption and lumen output of claim 34 further characterized in that said method limits power consumption and lumen output of a plurality of phosphor excitable lamps in a series circuit arrangement of such lamps with respect to each other and with respect to a source of power for operation of said lamps, said method comprising interposing the capacitive means between the conductive terminal of at least one of the sockets and the end terminal of the lamp at that socket.

39. The method of claim 34 further characterized in that said lamp is a fluorescent lamp.

40. A capacitive operable means for limiting power consumption and lumen output of a phosphor excitable lamp connected to a source of power for operation of same without any appreciable loss in efficiency of operation, said capacitive operable means comprising:

(a) a first conductive element operatively engagable with an electically conductive terminal on said lamp, (b) a second conductive element electrically connectable to said source of power, (c) an electrically non-conductive element separating said first and second conductive elements, and (d) a capacitor means connected between said first and second conductive elements, said capacitor means thereby being electrically connectable to one terminal of said phosphor excitable lamp, said capacitor means being located to interrupt the connection between the electrically conductive terminal on said lamp and the source of power and to be effectively electrically interposed between said lamp and source of power in a series connection without disconnecting anything other than said lamp, said capacitor means being selected with a capacitive value so that the lumen output at the reduced level and the power consumption is reduced without substantially changing the voltage to the lamp and without any appreciable effect on the efficiency of operation of said lamp or source of power.

41. The means for limiting power consumption and lumen output of claim 40 further characterized in that said capacitor means is capable of being electrically connected without connecting or disconnecting anything other than said lamp.

42. The means for limiting power consumption and lumen output of claim 40 further characterized in that said capacitor means has a capacitive value from about eight microfarads to about fourteen microfarads.

43. The means for limiting power consumption and lumen output of claim 40 further characterized in that said capacitor means has a capacitive value from about nine microfarads to about twelve microfarads.

44. The means for limiting power consumption and lumen output of claim 40 further characterized in that said capacitor means is used to limit power consumption and lumen output of a plurality of phosphor excitable lamps in a series circuit arrangement of such lamps with respect to each other and with respect to a source of power for operation of said lamps, said capacitor means being adapted to be interposed between one of the lamps and the source of power.

45. The means for limiting power consumption and lumen output of claim 40 further characterized in that said lamp is a fluorescent lamp.

46. A capacitive operable means for limiting power consumption and correspondingly limiting lumen output of a phosphor excitable lamp in a fixture having a pair of spaced apart sockets with each having a conductive terminal and which sockets retain and connect end terminals of a phosphor excitable lamp, said capacitive operable means comprising:

(a) a first conductive element operatively engagable with a terminal on said lamp, (b) a second conductive element electrically connectable to said conductive terminal of said socket, (c) an electrically non-conductive element separating said first and second conductive elements, and (d) a capacitor connected across said first and second conductive elements, such that the capacitor is located to interrupt and prevent direct physical connection between the conductive terminal in at least one of the sockets and the end terminal of the lamp at that socket, said capacitor thereby being operatively interposed between the conductive terminal in said one of the sockets and the end terminal of the lamp at that socket so that a circuit path is not created directly between the conductive terminal of the socket and the end terminal of the lamp but rather through the capacitor to thereby limit power consumption and lumen output without appreciably affecting efficiency of operation of said lamp.

47. The means for limiting power consumption and correspondingly limiting lumen output of claim 46 further characterized in that said capacitor is effectively electrically interposed between a source of electrical power for said lamp and said lamp and said capacitor being selected with a capacitive value so that the lumen output is reduced but with substantially uniform lumen output at the reduced level and the power consumption is reduced without substantially changing the voltage to the lamp and without any appreciable effect on the efficiency of operation of said lamp or source of power.

48. The means for limiting power consumption and lumen output of claim 46 further characterized in that said capacitor has a capacitive value from about eight microfarads to about fourteen microfarads.

49. The means for limiting power consumption and lumen output of claim 46 further characterized in that said capacitor has a capacitive value from about nine microfarads to about twelve microfarads.

50. The means for limiting power consumption and lumen output of claim 46 further characterized in that:

(a) said first conductive element is adapted to be engaged by and establish an electrical connection with an end terminal of said lamp, (b) said second conductive element is adapted to engage and establish an electrical connection with a conductive terminal of said socket, (c) said electrically non-conductive element between said first and second conductive elements electrically insulates same, and (d) said capacitor is electrically connected to said first and second conductive elements such that an electrical circuit path is not established directly through the end terminal of said lamp and the conductive terminal of said socket when said device is used, but rather through the end terminal of said lamp and said capacitor and the conductive terminal of said socket.

51. The means for limiting power consumption and lumen output of claim 50 further characterized in that said conductive elements and said non-conductive elements are enclosed within a housing.

52. The means for limiting power consumption and lumen output of claim 50 further characterized in that a recess is formed in said housing and communicating with said first conductive element, and a prong is located on said housing and is in electrical contact with said second conductive element and adapted to extend into said socket.

53. The means for limiting power consumption and lumen output of claim 46 further characterized in that said capacitive operable means is used to limit power consumption and lumen output of a plurality of phosphor excitable lamps in a series circuit arrangement of such lamps with respect to each other and with respect to a source of power for operation of said lamps, said capacitor being adapted to be interposed between the conductive terminal of at least one of the sockets and the end terminal of the lamp at that socket.

54. The means for limiting power consumption and lumen output of claim 46 further characterized in that said lamp is a fluorescent lamp.

55. A device for limiting the power consumed by an excitable phosphor lamp having end terminals which are electrically connectable to conductive terminals in a pair of spaced apart sockets adapted to retain said phosphor excitable lamp, and where said device is adapted to be interposed between one of the end terminals of said lamp and said socket to establish a different electrical circuit path between said conductive terminals of said socket and said end terminal of said lamp, said device comprising:

(a) a first conductive element, adapted to be engaged by and establish electrical connection with an end terminal of said lamp, (b) a second conductive element adapted to engage and establish electrical connection with a conductive terminal of said socket, (c) an electrically non-conductive element between said first and second conductive element electrically insulating same, (d) a capacitor spaced apart from said conductive elements, and (e) conductive wires electrically connected to said capacitor and said first and second conductive elements such that an electrical circuit path is not established directly through the end terminal of said lamp and the conductive terminal of said socket when said device is used but rather through the end terminal of said lamp and said capacitor and the conductive terminal of said socket.

56. The device of claim 55 further characterized in that said conductive elements and said non-conductive elements are enclosed within a housing.

57. The device of claim 56 further characterized in that a recess is formed in said housing and communicating with said first conductive element, and a prong is located on said housing and is in electrical contact with said second conductive element and adapted to extend into said socket.

58. The device of claim 55 further characterized in that said device is used to limit power consumption and lumen output of a plurality of phosphor excitable lamps in a series circuit arrangement of such lamps with respect to each other and with respect to a source of power for operation of said lamps, said device being adapted to be interposed between the conductive terminal of at least one of the sockets and the end terminal of the lamp at that socket.

59. The device of claim 55 characterized in that said lamp is a fluorescent lamp.

* * * * *